US009731516B2

(12) United States Patent
Hoshino

(10) Patent No.: US 9,731,516 B2
(45) Date of Patent: Aug. 15, 2017

(54) IMAGE FORMING APPARATUS, IMAGE FORMING PROGRAM, AND IMAGE FORMING METHOD

(71) Applicant: Yoshiaki Hoshino, Kanagawa (JP)

(72) Inventor: Yoshiaki Hoshino, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/066,699

(22) Filed: Mar. 10, 2016

(65) Prior Publication Data

US 2016/0263914 A1 Sep. 15, 2016

(30) Foreign Application Priority Data

Mar. 11, 2015 (JP) ..... 2015-048678

(51) Int. Cl.
*B41J 11/00* (2006.01)

(52) U.S. Cl.
CPC ..... *B41J 11/002* (2013.01)

(58) Field of Classification Search
CPC ..... B41J 11/005; B41J 3/4078; B41J 11/002
See application file for complete search history.

(56) References Cited

U.S. PATENT DOCUMENTS

| | | | | |
|---|---|---|---|---|
| 2008/0137147 | A1 | 6/2008 | Nakano et al. | |
| 2009/0018881 | A1 | 1/2009 | Ito et al. | |
| 2009/0179934 | A1 | 7/2009 | Takagi et al. | |
| 2010/0309243 | A1 | 12/2010 | Nakano et al. | |
| 2011/0273746 | A1 | 11/2011 | Hoshino et al. | |
| 2013/0293617 | A1* | 11/2013 | Suzuki | B41J 11/002 347/16 |
| 2014/0139607 | A1 | 5/2014 | Hayashi et al. | |
| 2016/0159107 | A1* | 6/2016 | Niu | B41M 5/00 442/142 |

FOREIGN PATENT DOCUMENTS

| | | | |
|---|---|---|---|
| JP | 5-093722 | A | 4/1993 |
| JP | 2002-347226 | A | 12/2002 |
| JP | 2010-208099 | A | 9/2010 |
| JP | 2013-109295 | A | 6/2013 |

* cited by examiner

*Primary Examiner* — Jason Uhlenhake
(74) *Attorney, Agent, or Firm* — Oblon, McClelland, Maier & Neustadt, L.L.P.

(57) ABSTRACT

An image forming apparatus includes an image forming unit, a drier, and a heater temperature control. The image forming unit includes nozzles to discharge droplets onto a web medium to form an image on the web medium. The drier includes a plurality of heaters over which the web medium is stretched to form an arc-shaped feed path. The heater temperature control is configured to control a temperature of an upstream heater of the plurality of heaters on the feed path to be higher than a temperature of a downstream heater of the plurality of heaters on the feed path.

8 Claims, 6 Drawing Sheets

| FEED SPEED (m/minute) | HEATER TEMPERATURE | |
|---|---|---|
| | ROLLER 401 | ROLLERS 402 THROUGH 406 |
| 50 | 120°C | 100°C |
| 80 | 140°C | 100°C |
| 100 | 160°C | 100°C |

| FEED SPEED (m/minute) | HEATER TEMPERATURE | | | |
|---|---|---|---|---|
| | ROLLER 401 | ROLLER 402 | ROLLER 403 | ROLLERS 404 THROUGH 406 |
| 50 | 120°C | 110°C | 100°C | 100°C |
| 80 | 140°C | 120°C | 110°C | 100°C |
| 100 | 160°C | 140°C | 120°C | 100°C |

FIG. 10

| BASIS WEIGHT ($g/m^2$) | HEATER TEMPERATURE | |
|---|---|---|
| | ROLLER 401 | ROLLERS 402 THROUGH 406 |
| LESS THAN 60$g/m^2$ | 120°C | 100°C |
| 60 $g/m^2$ OR GREATER AND LESS THAN 100 $g/m^2$ | 140°C | 100°C |
| 100 $g/m^2$ OR GREATER | 160°C | 100°C |

FIG. 11

| BASIS WEIGHT ($g/m^2$) | HEATER TEMPERATURE | | | |
|---|---|---|---|---|
| | ROLLER 401 | ROLLER 402 | ROLLER 403 | ROLLERS 404 THROUGH 406 |
| LESS THAN 60$g/m^2$ | 120°C | 120°C | 100°C | 100°C |
| 60 $g/m^2$ OR GREATER AND LESS THAN 100 $g/m^2$ | 140°C | 140°C | 100°C | 100°C |
| 100 $g/m^2$ OR GREATER | 160°C | 160°C | 100°C | 100°C |

FIG. 12

| MAXIMUM INK ADHESION AMOUNT ($\mu$l/inch^2) | HEATER TEMPERATURE | |
|---|---|---|
| | ROLLER 401 | ROLLERS 402 THROUGH 406 |
| LESS THAN 2.0 | 120°C | 100°C |
| 2.0 OR GREATER AND LESS THAN 3.0 | 140°C | 100°C |
| 3.0 OR GREATER | 160°C | 100°C |

FIG. 13

| MAXIMUM INK ADHESION AMOUNT ($\mu$l/inch^2) | HEATER TEMPERATURE | | | |
|---|---|---|---|---|
| | ROLLER 401 | ROLLER 402 | ROLLER 403 | ROLLERS 404 THROUGH 406 |
| LESS THAN 2.0 | 120°C | 110°C | 100°C | 100°C |
| 2.0 OR GREATER AND LESS THAN 3.0 | 140°C | 120°C | 110°C | 100°C |
| 3.0 OR GREATER | 160°C | 140°C | 120°C | 100°C |

IMAGE FORMING APPARATUS, IMAGE FORMING PROGRAM, AND IMAGE FORMING METHOD

CROSS-REFERENCE TO RELATED APPLICATION

This patent application is based on and claims priority pursuant to 35 U.S.C. §119(a) to Japanese Patent Application No. 2015-048678, filed on Mar. 11, 2015, in the Japan Patent Office, the entire disclosure of which is hereby incorporated by reference herein.

BACKGROUND

Technical Field

Aspects of the present disclosure relate to an image forming apparatus, an image forming program, and an image forming method.

Related Art

There is an image forming apparatus for performing an image forming operation, such as a printing operation, on a recording medium wound in a form of a roll (hereinafter, referred to as a continuous sheet of paper). In such an image forming apparatus, a sheet feed device of the continuous sheet is provided at an upstream side of a feed path of the continuous sheet, and a realer of the continuous sheet is provided at a downstream side of the feed path. Then, a reeling operation of a reeling unit is performed to apply tension to the continuous sheet, and thus the continuous sheet moves along the feed path. A feed roller provided along the feed path of the continuous sheet, a driving device for rotating and driving the feed roller, and a drier for drying an ink discharged to the continuous sheet can be provided inside the image forming apparatus. The image forming apparatus having such a configuration is designed on the assumption that a shape or characteristics of the continuous sheet is in a normal state, and there is an image forming apparatus capable of performing a high-speed image forming operation.

However, in the image forming apparatus for performing the high-speed image forming operation, there is a concern that the continuous sheet can be fed before the ink is dried, resulting in causing an offset by the ink during the reeling operation and deterioration in printing quality.

SUMMARY

In an aspect of this disclosure, there is provided an image forming apparatus that includes an image forming unit, a drier, and a heater temperature control. The image forming unit includes nozzles to discharge droplets onto a web medium to form an image on the web medium. The drier includes a plurality of heaters over which the web medium is stretched to form an arc-shaped feed path. The heater temperature control is configured to control a temperature of an upstream heater of the plurality of heaters on the feed path to be higher than a temperature of a downstream heater of the plurality of heaters on the feed path.

In another aspect of this disclosure, there is provided a non-transitory recording medium storing an image forming program for executing an image forming method for an image forming apparatus that includes an image forming unit having nozzles to discharge droplets onto a web medium to form an image on the web medium and a drier including a plurality of heaters over which the web medium is stretched to form an arc-shaped feed path. The method includes controlling a temperature of an upstream heater of the plurality of heaters on the feed path to be higher than a temperature of a downstream heater of the plurality of heaters on the feed path.

In another aspect of this disclosure, there is provided an image forming method for an image forming apparatus that includes an image forming unit having nozzles to discharge droplets onto a web medium to form an image on the web medium and a drier including a plurality of heaters over which the web medium is stretched to form an arc-shaped feed path. The method includes controlling a temperature of an upstream heater of the plurality of heaters on the feed path to be higher than a temperature of a downstream heater of the plurality of heaters on the feed path.

BRIEF DESCRIPTION OF THE SEVERAL VIEWS OF THE DRAWINGS

A more complete appreciation of the disclosure and many of the attendant advantages and features thereof can be readily obtained and understood from the following detailed description referring to the accompanying drawings, wherein:

FIG. 10 is a diagram illustrating a temperature control of heaters based on a basis weight of a continuous sheet;

FIG. 11 is a diagram illustrating a temperature control of heaters based on a basis weight of a continuous sheet;

FIG. 12 is a diagram illustrating a temperature control of heaters based on a maximum ink adhesion amount of a continuous sheet;

FIG. 13 is a diagram illustrating a temperature control of heaters based on a maximum ink adhesion amount of a continuous sheet;

Figure 1:
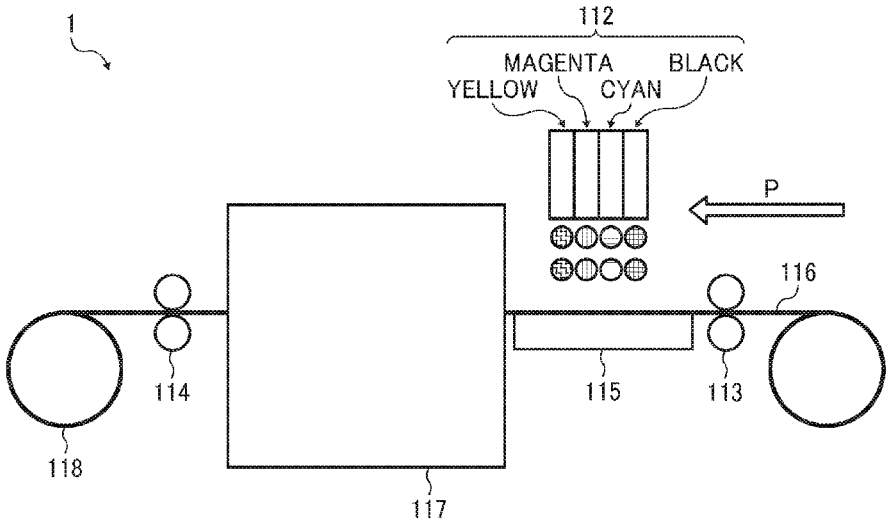
FIG. 1 is a schematic view of a configuration of an image forming apparatus according to the present embodiment.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

An embodiment of the present disclosure will be described below in detail referring to the accompanying drawings. In the present embodiment, the description will be given with respect to an example in which the present disclosure is applied to an image forming apparatus for forming an image on a continuous sheet of paper as a recording medium wound in the form of a roll. First, a structure of an image forming apparatus according to an embodiment of the present disclosure will be described based on a schematic view of a configuration of an image forming apparatus illustrated in FIG. 1.

An image forming apparatus 1 illustrated in FIG. 1 includes an inkjet head unit 112, a sheet feeder 113, paired reel rollers 114, a platen 115, a continuous sheet of paper 116, a drier 117, and a reeling unit 118.

The inkjet head unit 112 has printing nozzles for discharging droplets, such as ink, and forming an image, and the nozzles are arranged in this order of Black, Cyan, Magenta, and Yellow from the sheet feeder 113 side. The printing nozzles may be in a configuration such that other color inks or inks for overcoat are applied. A pigment is used as each color ink, but a dye can be also used as a color material, and the inkjet head unit 112 may be a head in which respective color inks are integrated. A driving method for the inkjet head unit 112 is not particularly limited. For example, a piezoelectric element actuator using lead zirconate titanate (PZT), a method of making heat energy to act, or a method of using an on-demand type head with an actuator using an electrostatic force can be also used. Printing can be also realized by using a charge controllable head of a continuous discharge type.

The sheet feeder 113 ejects the continuous sheet 116 wound in the form of a roll to the platen 115. Inks are discharged to the continuous sheet 116 reaching the platen 115 from the inkjet head unit 112 to perform an image forming operation, and the continuous sheet 116 is ejected. Therefore, the continuous sheet 116 becomes an image recording medium. By the platen 115, the continuous sheet 116 is fed in a direction indicated by arrow P in FIG. 1 while being horizontally held with respect to inkjet head unit 112.

The drier 117 performs a drying operation of the continuous sheet 116 subjected to the image forming operation. The paired reel rollers 114 and the reeling unit 118 reel the continuous sheet 116 subjected to the drying operation in a form of a roll. When the continuous sheet 116 is reeled in the form of the roll by the paired reel rollers 114 and the reeling unit 118, tension is applied to the continuous sheet 116, and the continuous sheet 116 is fed toward the reeling unit 118 from the sheet feeder 113. Hereinafter, in the feed path of the continuous sheet 116, a side close to the sheet feeder 113 is defined as an upstream side and a side close to the reeling unit 118 is defined as a downstream side.

Figure 2:
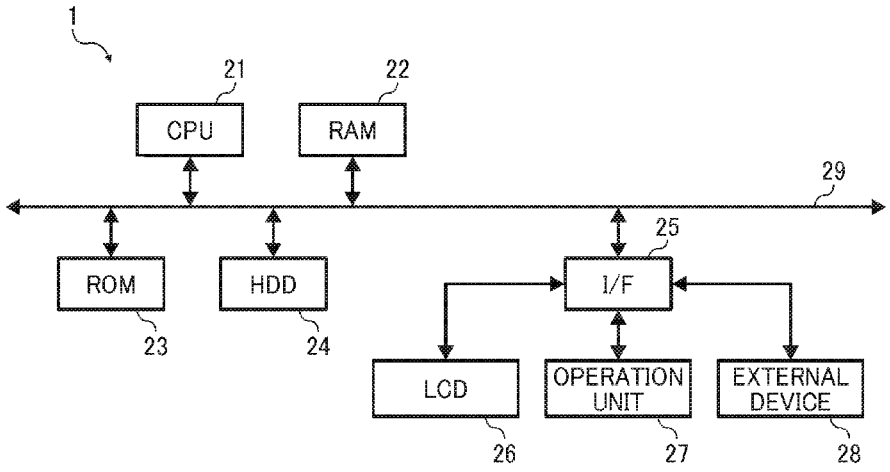
FIG. 2 is a configuration diagram of hardware of the image forming apparatus illustrated in FIG. 1.

A configuration of hardware of the image forming apparatus 1 will be described below referring to FIG. 2. FIG. 2 is a block diagram illustrating a hardware configuration of the image forming apparatus 1 according to the present embodiment.

As illustrated in FIG. 2, the image forming apparatus 1 according to the present embodiment is similar in configuration to an information processing terminal, such as a general server or a personal computer (PC). That is, in the image forming apparatus 1 according to the present embodiment, a central processing unit (CPU) 21, a random access memory (RAM) 22, a read only memory (ROM) 23, a hard disk drive (HDD) 24, and an I/F 25 are connected to each other via a bus 29. The I/F 25 is connected with a liquid crystal display (LCD) 26 and an operation unit 27. Signals are transmitted and received to/from an external device 28 connected to the image forming apparatus 1 via the I/F 25.

The CPU 21 is an arithmetic unit and controls the operation of the entire image forming apparatus 1. The RAM 22 is a volatile storage medium capable of reading and writing information at a high speed and is used as a working area during information processing of the CPU 21. The ROM 23 is a read-only non-volatile storage medium and stores a program, such as firmware. The HDD 24 is a non-volatile storage medium capable of reading and writing information and stores operating system (OS), various control programs, application programs, for example.

The I/F 25 connects the bus 29 with various types of hardware and networks and performs control. The LCD 26 is a visual user interface for a user confirming the state of the image forming apparatus 1. The operation unit 27 is a user interface, such as a keyboard or a mouse, for the user inputting information to the image forming apparatus 1. The external device 28 is hardware for realizing a specific function of the image forming apparatus 1, and is, for example, a print engine for executing an image forming operation on the recording medium.

In such a hardware configuration, the programs stored in the ROM 23 and the HDD 24 or a storage medium, such as an optical disk, are read by the RAM 22, and an arithmetic operation is performed according to the programs loaded in RAM 22 by the CPU 21 to configure a software control. The software control configured in this way is combined with the hardware to configure a functional block for realizing functions of the image forming apparatus 1 according to the present embodiment.

Figure 3:
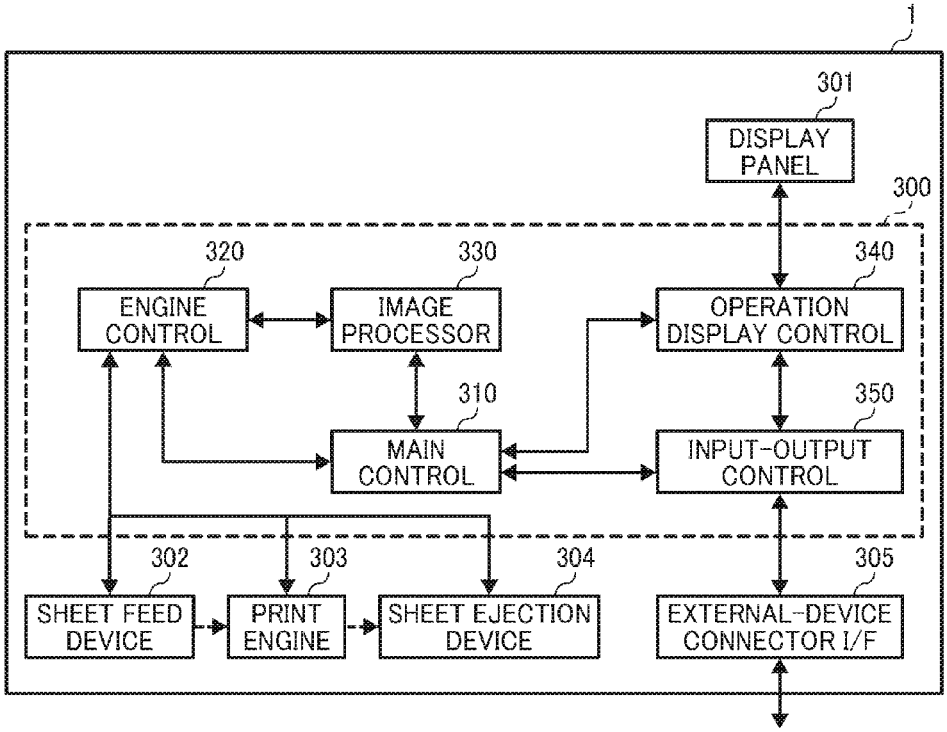
FIG. 3 is an illustration of an internal configuration of the image forming apparatus illustrated in FIG. 1.

Next, referring to a functional block diagram of the image forming apparatus 1 according to the present embodiment illustrated in FIG. 3, a functional configuration of the image forming apparatus 1 will be described. As illustrated in FIG. 3, the image forming apparatus 1 includes a controller 300, a display panel 301, a sheet feed device 302, a print engine 303, a sheet ejection device 304, and an external-device connector interface (I/F) 305.

The controller 300 includes a main control 310, an engine control 320, an image processor 330, an operation display control 340, and an input-output control 350. In FIG. 3, electrical connections are indicated by solid arrows, and a flow of sheet of paper is indicated by a broken line.

The display panel 301 is not only an output interface that visually displays status of the image forming apparatus 1 but also an input interface (operation unit) that a user directly operates the image forming apparatus 1 using a touch panel or inputs information to the image forming apparatus 1. The external-device connector interface (I/F) 305 is an interface for communicating other devices through a network or an inter-device connection cable, and Ethernet (registered trademark) and universal serial bus (USB) interface are used for the external-device connector interface (I/F) 305.

The controller 300 is configured by a combination of software and hardware. In particular, control programs, such as firmware, stored in the non-volatile storage medium, such as the ROM 23, the HDD 24, or an optical disk, are loaded into a volatile memory (hereinafter, referred to as a memory), such as the RAM 22, and the controller 300 is configured by the software control and the hardware, such as an integrated circuit, to be configured according to the control of the CPU 21. The controller 300 functions as a controller that controls the entire image forming apparatus 1.

The main control 310 plays a role of controlling each unit included in the controller 300 and gives commands to each unit of the controller 300. The engine control 320 serves as a driver that controls and drives the print engine 303.

The input-output control 350 inputs signals and commands input through the external-device connector interface (I/F) 305 to the main control 310. The main control 310 controls the input-output control 350 and accesses other devices through the external-device connector interface (I/F) 350.

The image processor 330 generates drawing information based on print information included in a print job to be input according to the control of the main control 310. The drawing information is information that the print engine 303 as an image forming unit draws as an image to be formed in an image forming operation. The print information included in the print job is image information that is converted into a format recognizable by the image forming apparatus 1 by a printer driver installed in an information processing device, such as a PC. The operation display control 340 displays information on the display panel 301 or notifies information input through the display panel 301 to the main control 310.

In the image forming apparatus 1, first, the input-output control 350 receives a print job through the external-device connector interface (I/F) 305. The input-output control 350 transfers the received print job to the main control 310. When receiving the print job, the main control 310 controls the image processor 330 to generate drawing information based on print information included in the print job.

When the drawing information is generated by the image processor 330, the engine control 320 executes an image forming operation on the sheet fed from the sheet feed device 302, based on the generated drawing information. That is, the print engine 303 functions as an image forming unit. A document subjected to the image forming operation by the print engine 303 is ejected to the outside of the apparatus by the sheet ejection device 304.

In the image forming apparatus 1, the image forming operation is performed on the continuous sheet 116 ejected from the sheet feeder 113 corresponding to the sheet feed device 302 by the inkjet head unit 112 corresponding to the print engine 303, the platen 115, and the drier 117. Then, the continuous sheet 116 is inserted between the paired reel rollers 114 and is then fed to the reeling unit 118 corresponding to the sheet ejection device 304. Each unit excluding the inkjet head unit 112 comes in contact with the continuous sheet 116 to be an object of the image forming operation along a feed path therein, and includes a feed roller that rotates toward a downstream side from an upstream side of the feed path of the continuous sheet 116 and constitutes the feed path of the continuous sheet 116.

The feed roller includes both a drive roller that is coupled to a driving device and is driven by a self-rotation with a feed speed and a so-called idler roller that is formed to move together with a feed movement of the continuous sheet 116. Tension is applied to the continuous sheet 116 by a reeling operation of the reeling unit 118 from the upstream side to the downstream side of the feed path. The feed roller formed as the idler roller is driven to rotate by the tension applied to the feed roller from a contact portion on the surface of the feed roller coming in contact with the continuous sheet 116.

Each of these units is driven and controlled by the engine control 320. When the feed operation is normally performed, the continuous sheet 116 moves toward the downstream side from the upstream side of the feed path by the tension applied by the reeling operation, and thus the feed roller also rotates.

However, the shape of the continuous sheet 116 may be deformed by degradation of the material of the continuous sheet 116 or the ink to be discharged during a printing operation. For this reason, a gap occurs between the continuous sheet 116 and feed roller, the gap expands during the feeding, and thus the continuous sheet 116 may be crushed by a nip pressure between the paired reel rollers 114 to make a wrinkle.

In the present embodiment, occurrence of the wrinkle in the continuous sheet 116 is reduced by controlling the image forming apparatus 1 according to factors, such as a feed speed, a basis weight of the continuous sheet 116, and the amount of ink to be discharged to the continuous sheet 116, which change the shape of the recording medium.

Figure 4:
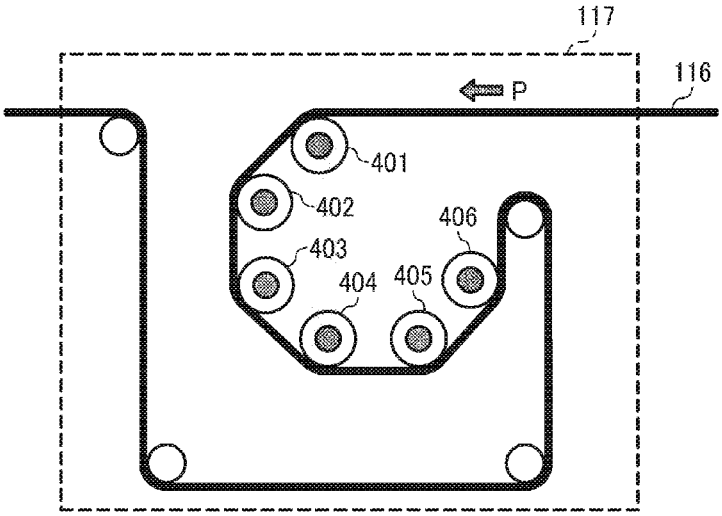
FIG. 4 is a side view of a drier having heating rollers illustrated in FIG. 1.

FIG. 4 is a side view of the drier 117 including heating rollers 401 to 406 according to the present embodiment. As illustrated in FIG. 4, the drier 117 includes the heating rollers 401 to 406 that have heaters therein, respectively, and a feed roller that feeds the continuous sheet 116. A heating method for the heaters respectively included in the heating rollers 401 to 406 is not limited to any manner, and a temperature of the heaters is measured by a temperature detecting element, such as a thermoresistor or a thermocpuple, and is controlled to a setting temperature by a temperature adjuster.

Figure 5:
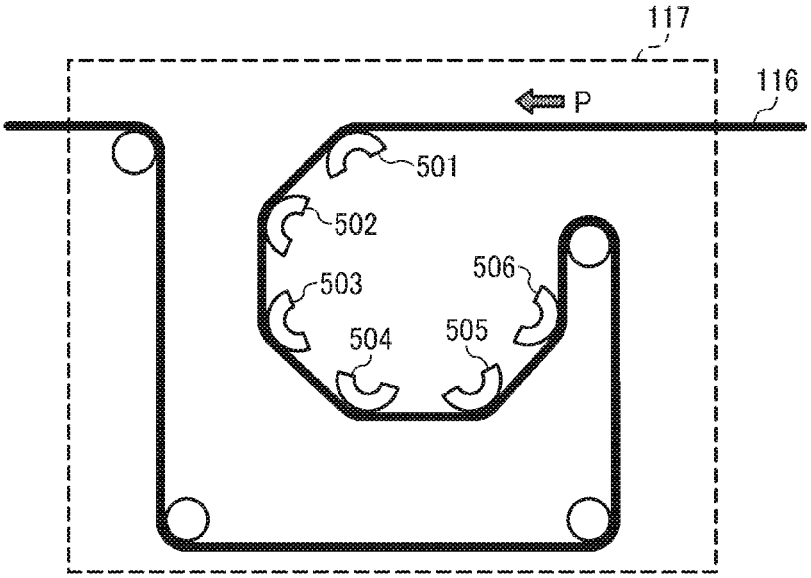
FIG. 5 is a side view of a drier having curved heaters illustrated in FIG. 1.

FIG. 5 is a side view of the drier 117 including curved heaters 501 to 506 according to the present embodiment. As illustrated in FIG. 5, the drier 117 includes the curved heaters 501 to 506 having curvature and a feed roller that feeds the continuous sheet 116. A heating method for the heaters respectively included in the curved heaters 501 to 506 is not limited to any manner, and a temperature of the heaters is measured by a temperature detecting element, such as a thermoresistor or a thermocpuple, and is controlled to a setting temperature by a temperature adjuster. The curved heaters 501 to 506 are not limited to a shape obtained in such a manner that a cylinder is cut in a longitudinal direction as illustrated in FIG. 5, and may have other shapes as long as being a shape having the same radius of curvature in a longitudinal direction.

Figure 6:
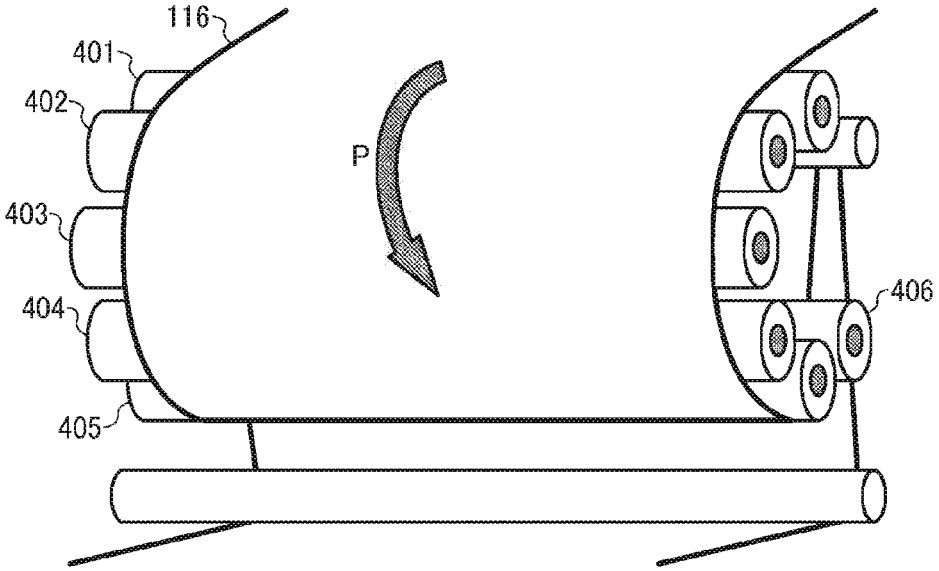
FIG. 6 is an illustration a drier having heating rollers illustrated in FIG. 1.

FIG. 6 is an illustration of the drier 117 according to the present embodiment. The continuous sheet 116 is fed in a direction indicated by arrow P in FIGS. 4 to 6. The direction indicated by arrow P is a direction from the platen 115 to the reeling unit 118. The continuous sheet 116 is wound in the form of a roll and is a long sheet of paper having a length at least equal to or larger than a length of the feed path from the sheet feeder 113 to reeling unit 118, but is a flexible medium, such as a sheet of web medium which is a relatively long. Accordingly, regardless of materials, along reelable recording medium is similarly applicable without being limited to the continuous sheet 116 that is a paper medium. By heating and feeding of the heating rollers 401 to 406 or the curved heaters 501 to 506 in this order, a drying operation of the continuous sheet 116 after the ink discharge is performed.

As illustrated FIG. 6, the heating rollers 401 to 406 are columnar rollers, and rotate around a rotation axis that is the center in a longitudinal direction of the column. The heating rollers 401 to 406 are disposed such that an axial direction (rotation axis direction/longitudinal direction) of the column is perpendicular to the feed path of the continuous sheet 116. Then, the heating rollers 401 to 406 are rotatably supported to a fixed body (for example, a housing of the drier 117) by a bearing at both lateral ends of the rotation axis.

As illustrated in FIGS. 4 and 6, the heating rollers 401 to 406 are disposed in an arc, and thus the feed path of the continuous sheet 116 has a curvature larger than that of the heating rollers 401 to 406. For this reason, when the tension is applied to the feed path of the continuous sheet 116, the continuous sheet 116 can be brought into close contact with the heating rollers 401 to 406. This is also applicable to the curved heaters 501 to 506.

The heating rollers 401 to 406 are rollers having a radius of curvature of 75 mm (diameter of 150 mm) or less when the basis weight of the continuous sheet 116 is less than 100 $g/m^2$ and a radius of curvature of 125 mm (diameter of 250 mm) or less when the basis weight of the continuous sheet 116 is 100 $g/m^2$ or more. The heating rollers 401 to 406 have a structure of a radius of curvature of at least 30 mm or more in consideration of the presence of a heat source in the heating rollers, strength of the heating rollers, and heating and drying efficiency with respect to the continuous sheet 116. For the same reason, the curved heaters 501 to 506 also have a curvature structure of a radius of curvature of 30 mm or more. When the heating rollers 401 to 406 and the curved heaters 501 to 506 have a replaceable configuration, members having a different radius of curvature can be also used depending on the basis weight of the continuous sheet 116.

The paired reel rollers 114 and the reeling unit 118 are provided at the downstream side of the feed path of the continuous sheet 116 passed through the drier 117 and thus perform a reeling operation of the heated and dried continuous sheet 116.

Figures 7, 8, 9:
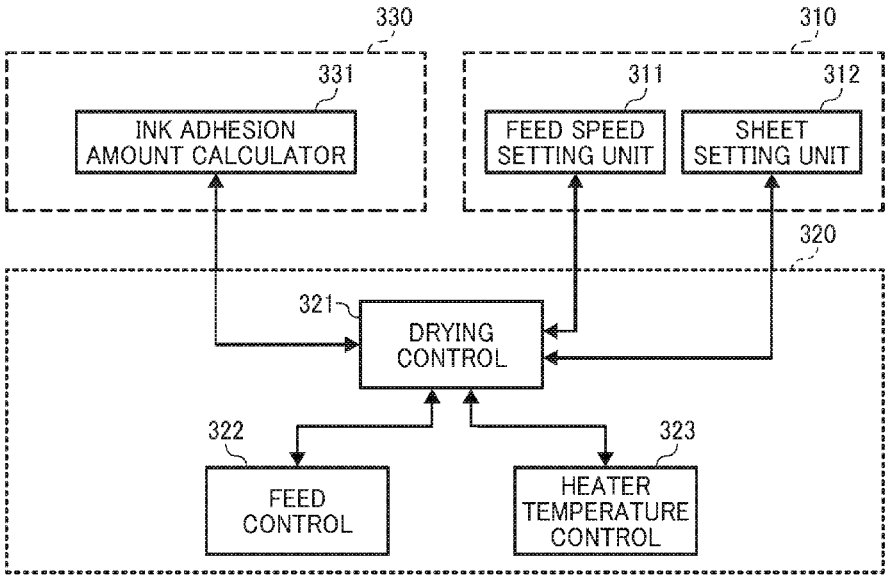
FIG. 7 is an illustration of an internal configuration of a drier illustrated in FIG. 1.
FIG. 8 is a diagram illustrating a temperature control of heaters based on a feed speed.
FIG. 9 is a diagram illustrating a temperature control of heaters based on a feed speed.

Referring to a control block diagram of the drier 117 illustrated in FIG. 7, a functional configuration of the drier 117 according to the present embodiment will be described. As illustrated in FIG. 7, the engine control 320 executes a driving control of the drier 117 referring to information for controlling an operation of the image forming apparatus 1 from the main control 310 and the image processor 330.

An ink adhesion amount calculator 331 is a function included in the image processor 330 to calculate the maximum ink adhesion amount of the continuous sheet 116 based on the drawing information and output it to the engine control 320. The maximum ink adhesion amount represents an ink adhesion amount per unit area, and is determined by counting the number of color pixels in an image of respective colors of CMYK constituting the drawing information. The maximum ink adhesion amount is determined by the amount of ink to be discharged to the continuous sheet 116 from the inkjet head unit 112. That is, the maximum ink adhesion amount corresponds to the ink discharge amount calculated based on the drawing information of an image to be printed.

A speed setting unit 311 is a function included in the main control 310 to output information on the feed speed of the continuous sheet 116 to the engine control 320, based on a feed speed input and set from the display panel 301 by a user of the image forming apparatus 1. When the image forming apparatus 1 has a configuration in which the feed speed of the continuous sheet 116 can be automatically sensed, it may refer to the sensed feed speed.

A sheet setting unit 312 is a function included in the main control 310 to output information of the basis weight of the continuous sheet 116 to the engine control 320, based on the basis weight of the continuous sheet 116 set in the sheet feed device 302 and input from the display panel 301 by the user of the image forming apparatus 1. When the image forming apparatus 1 has a configuration in which the feed speed of the continuous sheet 116 can be automatically sensed, it may refer to the sensed basis weight.

Each type of information output to the engine control 320 from the speed setting unit 311, the sheet setting unit 312, and the ink adhesion amount calculator 331 is transferred to a drying control 321 as control information of the drier 117.

Further, the drying control 321 controls a feed control 322 and a heater temperature control 323, based on the acquired control information of the drier 117.

The feed control 322 performs a driving control of the feed roller having a driving function based on control instruction of the drying control 321 and controls of the feed speed.

The heater temperature control 323 executes a temperature control of the heaters, which are respectively provided in the heating rollers 401 to 406, and the curved heaters 501 to 506, based on control instruction of the drying control 321.

FIGS. 8 to 13 are diagrams illustrating examples of executing the temperature control of the heaters provided respectively in the heating rollers 401 to 406 included in the drier 117, based on the feed speed, the sheet setting and the maximum ink adhesion amount. Even in the case of executing the temperature control of the curved heaters 501 to 506, it is possible to obtain the same effect as in the case of executing the temperature control of the heaters provided respectively in the heating rollers 401 to 406.

FIG. 8 is a diagram illustrating a setting temperature when the drying control 321 executes two types of temperature control of the heaters provided respectively in the heating rollers 401 to 406, based on the feed speed. As illustrated in FIG. 8, a temperature of the heater is set based on the feed speed such that a temperature of the heater provided in the heating roller on the upstream side of the feed path is higher than a temperature of the heaters provided in other heating rollers on the downstream side of the feed path.

FIG. 9 is a diagram illustrating a setting temperature when the drying control 321 executes two types of temperature control of the heaters provided respectively in the heating rollers 401 to 406, based on the feed speed. As illustrated in FIG. 9, a temperature is set based on the feed speed such that a temperature of the heater becomes gradually lower as the sheet is fed to the heating roller on the downstream side of the feed path from the heating roller on the upstream side of the feed path.

In FIGS. 8 and 9, as the feed speed of the continuous sheet 116 becomes faster, the temperature of the heater is set to be higher. This is because a contact time between the continuous sheet 116 and the heating rollers 401 to 406 becomes shorter as the feed speed becomes faster and thus a situation where the continuous sheet 116 and the ink are hardly dried happens. For this reason, by heating of the continuous sheet 116 at a higher temperature, the temperature thereof is raised, and thus the drying of the continuous sheet 116 and the ink is further facilitated. The temperature of the heater of the heating roller 401 on the upstream side of the feed path is set to be higher, the temperature of the continuous sheet 116 and the ink fed to the drier 117 is quickly transited to a heating and drying temperature, and thus the drying of the continuous sheet 116 and the ink can be also facilitated. A relation between the feed speed illustrated in FIGS. 8 and 9 and the temperature control of the heaters provided respectively in the heating rollers 401 to 406 is illustrative, and, in actual, it is desirable to check and adjust a drying state of the ink.

FIG. 10 is a diagram illustrating a setting temperature when the drying control 321 executes two types of temperature control of the heaters provided respectively in the heating rollers 401 to 406, based on the basis weight of the continuous sheet 116. As illustrated in FIG. 10, a temperature is set based on the basis weight of the continuous sheet 116 such that a temperature of the heater of the heating roller on the upstream side of the feed path becomes higher than a temperature of the heaters of other heating rollers on the downstream side of the feed path.

FIG. 11 is a diagram illustrating a setting temperature when the drying control 321 executes two types of temperature control of the heaters provided respectively in the heating rollers 401 to 406, based on the basis weight of the continuous sheet 116. As illustrated in FIG. 11, a temperature is set based on the basis weight of the continuous sheet 116 such that a temperature of the heater becomes gradually lower as the sheet is fed to the heating roller on the downstream side of the feed path from the heating roller on the upstream side of the feed path.

In FIGS. 10 and 11, as the basis weight of the continuous sheet 116 becomes larger, the temperature of the heaters of the heating rollers is set to be higher. This is because a thickness of the continuous sheet 116 increases as the basis weight becomes larger and thus a situation where the continuous sheet 116 and the ink are hardly dried happens. For this reason, by heating of the continuous sheet 116 at a higher temperature, the temperature thereof is raised, and thus the drying of the continuous sheet 116 and the ink is further facilitated. The temperature of the heater of the heating roller 401 on the upstream side of the feed path is set to be higher, the temperature of the continuous sheet 116 and the ink fed to the drier 117 is quickly transited to a heating and drying temperature, and thus the drying of the continuous sheet 116 and the ink can be also facilitated. A relation between the basis weight of the continuous sheet 116 illustrated in FIGS. 10 and 11 and the temperature control of the heaters provided respectively in the heating rollers 401 to 406 is illustrative, and, in actual, it is desirable to check and adjust a drying state of the ink.

FIG. 12 is a diagram illustrating a setting temperature when the drying control 321 executes two types of temperature control of the heaters provided respectively in the heating rollers 401 to 406, based on the maximum ink adhesion amount of the continuous sheet 116. As illustrated in FIG. 12, a temperature is set based on the maximum ink adhesion amount of the continuous sheet 116 such that a temperature of the heater provided in the heating roller on the upstream side of the feed path is higher than a temperature of the heaters provided in other heating rollers on the downstream side of the feed path.

FIG. 13 is a diagram illustrating a setting temperature when the drying control 321 executes two types of temperature control of the heaters provided respectively in the heating rollers 401 to 406, based on the maximum ink adhesion amount of the continuous sheet 116. As illustrated in FIG. 13, a temperature is set based on the maximum ink adhesion amount of the continuous sheet 116 such a temperature of the heater becomes gradually lower as the sheet is fed to the heating roller on the downstream side of the feed path from the heating roller on the upstream side of the feed path.

In FIGS. 12 and 13, as the maximum ink adhesion amount of the continuous sheet 116 becomes larger, the temperature of the heater of the heating roller is set to be higher. This is because the drying of the continuous sheet 116 and the ink can be facilitated by heating of the continuous sheet 116 at a higher temperature and raising the temperature thereof. The temperature of the heater of the heating roller 401 on the upstream side of the feed path is set to be higher, the temperature of the continuous sheet 116 and the ink fed to the drier 117 is quickly transited to a heating and drying temperature, and thus the drying of the continuous sheet 116 and the ink can be also further facilitated. A relation between the maximum ink adhesion amount of the continuous sheet 116 illustrated in FIGS. 12 and 13 and the temperature control of the heaters provided respectively in the heating rollers 401 to 406 is illustrative, and it is desirable to actually check and adjust a drying state of the ink.

The temperature control of the heaters illustrated in FIGS. 8 to 13 is executed such that the temperature of the upstream heater of the feed path of the continuous sheet 116 is set to be high and the temperature of the heater on the downstream side of the feed path is set to be lower than the temperature of the upstream heater of the feed path. The reason is that to lower the temperature of the heater on the downstream side of the feed path serves to reducing an excessive dry of the continuous sheet 116.

As described above, when the temperature control of the heating rollers is executed based on the feed speed, the basis weight, and the maximum ink adhesion amount of the continuous sheet 116, the continuous sheet 116 can be efficiently heated, and the ink discharged to the continuous sheet 116 can be dried. The temperature control of the heaters may be executed referring to any two or all of the feed speed, the basis weight, and the maximum ink adhesion amount of the continuous sheet 116. Even in this case, it is desirable to check and adjust the drying state of the ink.

Figure 14:
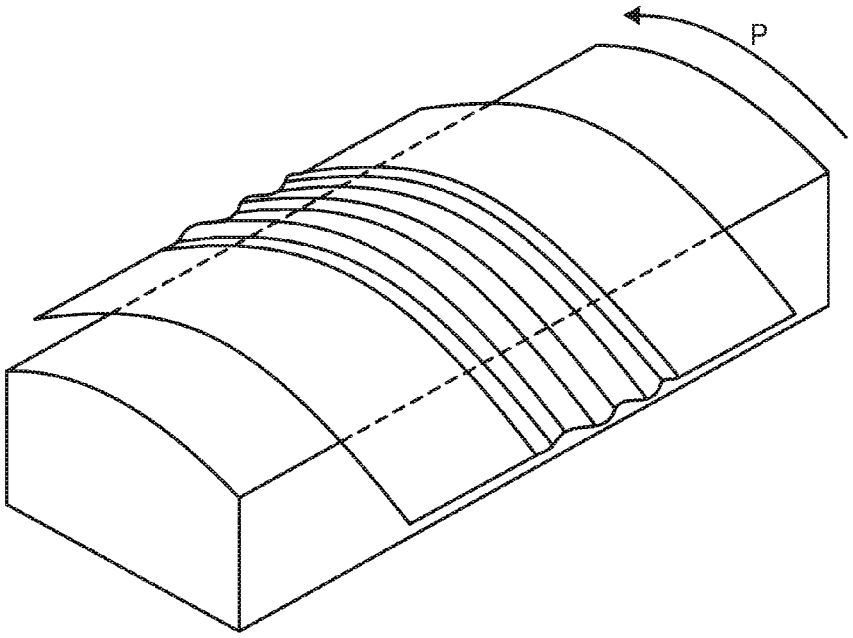
FIG. 14 is a diagram illustrating a drying aspect of a continuous sheet by a heater having a large radius of curvature.
Figure 15:
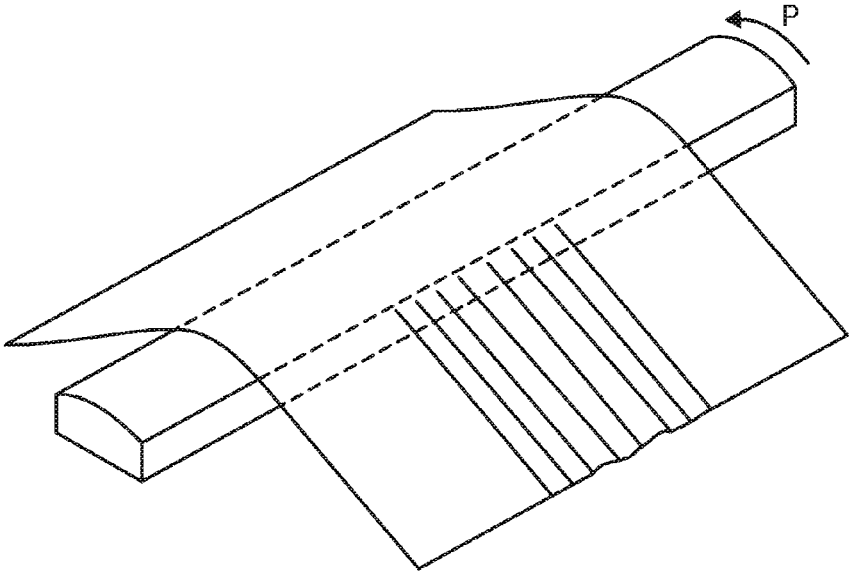
FIG. 15 is a diagram illustrating a drying aspect of a continuous sheet by a heater having a small radius of curvature.

Further, the heating rollers 401 to 406 and the curved heaters 501 to 506 of the drier 117 according, to the present embodiment are characterized in that the radius of curvature is small. Referring to FIGS. 14 and 15, a drying aspect of the continuous sheet 116 by the heater 501 having the small radius of curvature will be described.

As illustrated in FIG. 14, when the curved heater 501 has a large radius of curvature, a contact area between the continuous sheet 116 and the curved heater 501 is also larger. In this case, the heating and drying of the continuous sheet 116 is facilitated, but the tension applied to the continuous sheet 116 is dispersed, whereby the continuous sheet 116 does not come in close contact with the curved heater 501. Accordingly, when the continuous sheet 116 is fed to the drier 117 in a state of being deformed in shape, the continuous sheet 116 is fed without elimination of the deformation, and thus wrinkles occur in a printed object by a nip pressure when the printed object passes between the paired reel rollers 114. This is also applicable to the heating rollers 401 to 406 and the curved heaters 501 to 506 having the large radius of curvature.

As illustrated in FIG. 15, when the curved heater 501 has a small radius of curvature, a contact area between the continuous sheet 116 and the curved heater 501 is smaller. In this case, tension applied to the contacted portion of the continuous sheet 116 is concentrated on one side in a longitudinal direction of the curved heater 501, and the continuous sheet 116 is fed in a state of coming in close contact with the curved heater 501. Accordingly, even when the continuous sheet 116 is fed to the drier 117 in a state of being deformed in shape, the deformation of the continuous sheet 116 can be eliminated. This is also applicable to the heating rollers 401 to 406 and the curved heaters 501 to 506 having the small radius of curvature.

Further, the drier 117 according to the present embodiment has a configuration in which the plurality of heating rollers 401 to 406 or the curved heaters 501 to 506 are disposed in an arc. With this configuration, the continuous sheet 116 may not be fed in a state of being inserted between the paired rollers. This makes it possible to avoid a situation that the nip pressure is applied to the continuous sheet 116 being still wet and prevent the occurrence of the wrinkles of the continuous sheet 116 due to the nip pressure.

As described above, the image forming apparatus 1 according to the present embodiment executes the temperature control of the heater provided in the drier 117 based on the feed speed, the basis weight, or the maximum ink adhesion amount of the continuous sheet 116. Since the heating rollers 401 to 406 or the curved heaters 501 to 506 constituting the drier 117 have the small radius of curvature, the continuous sheet 116 can be fed in the state of coming in close contact with the rollers, and the occurrence of the wrinkles on the continuous sheet 116 can be reduced. Accordingly, in the image forming apparatus, the image forming program, and the image forming method according to embodiments of the present disclosure, when the high-speed image forming operation, such as the printing operation, is performed on the continuous sheet 116, it is possible to reduce the occurrence of the wrinkles on the continuous sheet 116.

When the temperature variable heaters included in the heating rollers 401 to 406 or the curved heaters 501 to 506 are made of a material having a high specific heat, the temperature of the heaters heated once is not lowered to a target set temperature. In this case, the control of the feed speed may be executed based on the temperature of each heater which is detected by the temperature detecting element provided in each heater. By the execution of such a control, it is possible to suppress the power required to execute the temperature control of the heaters. Even when the feed speed is controlled based on the temperature of the heaters, it is desirable to check and adjust the drying state of the ink.

Numerous additional modifications and variations are possible in light of the above teachings. It is therefore to be understood that within the scope of the appended claims, the disclosure of the present invention may be practiced otherwise than as specifically described herein. For example, the image forming method and the image forming program according to the above-described embodiments are applicable to an image processing apparatus. In addition, elements and/or features of different illustrative embodiments may be combined with each other and/or substituted for each other within the scope of this invention and appended claims.

Each of the functions of the described embodiments may be implemented by one or more processing circuits or circuitry. Processing circuitry includes a programmed processor, as a processor includes circuitry. A processing circuit also includes devices, such as an application specific integrated circuit (ASIC), digital signal processor (DSP), field programmable gate array (FPGA), and conventional circuit components, arranged to perform the recited functions.

As described above, the present invention can be implemented in any convenient form, for example using dedicated hardware, or a mixture of dedicated hardware and software. The present invention may be implemented as computer software implemented by one or more networked processing apparatuses. The network can comprise any conventional terrestrial or wireless communications network, such as the Internet. The processing apparatuses can compromise any suitably programmed apparatuses such as a general purpose computer, personal digital assistant, mobile telephone (such as a WAP or 3G-compliant phone) and so on. Since the present invention can be implemented as software, each and every aspect of the present invention thus encompasses computer software implementable on a programmable device. The computer software can be provided to the programmable device using any storage medium for storing processor readable code such as a floppy disk, hard disk, CD ROM, magnetic tape device or solid state memory device.

What is claimed is:

1. An image forming apparatus comprising:

an image forming unit including nozzles to discharge droplets onto a web medium to form an image on the web medium;

a drier including a plurality of heaters over which the web medium is stretched to form an arc-shaped feed path; and a heater temperature controller configured to control a temperature of an upstream heater of the plurality of heaters on the feed path to be higher than a temperature of a downstream heater of the plurality of heaters on the feed path, wherein the heater temperature controller is configured to execute a temperature control of the plurality of heaters such that a temperature difference between the upstream heater and the downstream heater is larger as a feed speed of the web medium is faster.

2. The image forming apparatus according to claim 1, wherein the drier includes a plurality of rollers forming the feed path of the web medium, and wherein the plurality of rollers includes the plurality of heaters inside the plurality of rollers.

3. The image forming apparatus according to claim 2, wherein the plurality of rollers has a radius of curvature of not more than a predetermined value.

4. The image forming apparatus according to claim 1, wherein the heater temperature controller is configured to execute a temperature control of the plurality of heaters such that a temperature difference between the upstream heater and the downstream heater is larger as a basis weight of the web medium is larger.

5. The image forming apparatus according to claim 1, wherein the heater temperature controller is configured to refer to a discharge amount of the droplets to be discharged to the web medium from the image forming unit and execute a temperature control of the plurality of heaters such that a temperature difference between the upstream heater and the downstream heater is larger as a discharge amount of the droplets per unit area of the web medium is larger.

6. The image forming apparatus according to claim 1, wherein the plurality of heaters has a radius of curvature of not more than a predetermined value.

7. A non-transitory recording medium storing an image forming program for executing an image forming method for an image forming apparatus that includes an image forming unit having nozzles to discharge droplets onto a web medium to form an image on the web medium and a drier including a plurality of heaters over which the web medium is stretched to form an arc-shaped feed path, the method comprising controlling a temperature of an upstream heater of the plurality of heaters on the feed path to be higher than a temperature of a downstream heater of the plurality of heaters on the feed path, wherein the controlling refers to a discharge amount of the droplets to be discharged to the web medium from the image forming unit and executes a temperature control of the plurality of heaters such that a temperature difference between the upstream heater and the downstream heater is larger as a discharge amount of the droplets per unit area of the web medium is larger.

8. An image forming method for an image forming apparatus that includes an image forming unit having nozzles to discharge droplets onto a web medium to form an image on the web medium and a drier including a plurality of heaters over which the web medium is stretched to form an arc-shaped feed path, the method comprising controlling a temperature of an upstream heater of the plurality of heaters on the feed path to be higher than a temperature of a downstream heater of the plurality of heaters on the feed path, wherein the controlling executes a temperature control of the plurality of heaters such that a temperature difference between the upstream heater and the downstream heater is larger as a basis weight of the web medium is larger.

* * * * *